US008449310B2

(12) United States Patent
Siebens

(10) Patent No.: US 8,449,310 B2
(45) Date of Patent: May 28, 2013

(54) TRIPLE CAM-OPERATED LINK

(75) Inventor: Larry N. Siebens, Asbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/312,316

(22) Filed: Dec. 6, 2011

(65) Prior Publication Data

US 2012/0202392 A1 Aug. 9, 2012

Related U.S. Application Data

(60) Provisional application No. 61/439,407, filed on Feb. 4, 2011.

(51) Int. Cl.
*H01R 13/62* (2006.01)

(52) U.S. Cl.
USPC ..... 439/181; 439/921; 439/512

(58) Field of Classification Search
USPC ..... 439/181–187, 921, 512, 189, 218, 439/507, 509, 510
See application file for complete search history.

(56) References Cited

U.S. PATENT DOCUMENTS 3,594,685 A 7/1971 Cunningham
4,799,895 A * 1/1989 Borgstrom ..... 439/183
4,820,183 A 4/1989 Knapp et al.
4,865,559 A 9/1989 Clabburn
4,955,823 A * 9/1990 Luzzi ..... 439/507
5,427,538 A 6/1995 Knapp et al.
6,198,062 B1 3/2001 Mather et al.
6,364,216 B1 4/2002 Martin
7,278,889 B2 10/2007 Muench et al.
7,427,207 B2 * 9/2008 Jackson, III ..... 439/181
7,972,155 B1 * 7/2011 Siebens ..... 439/181
2008/0045058 A1 * 2/2008 Stepniak et al. ..... 439/187

* cited by examiner

*Primary Examiner* — Gary F. Paumen
(74) *Attorney, Agent, or Firm* — Snyder, Clark, Lesch & Chung, LLP

(57) ABSTRACT

A high voltage link apparatus may include a link assembly that includes an insulated bushing portion; a first feed thru junction bushing portion; and a second feed thru junction bushing portion. The insulated bushing portion is electrically isolated from the first feed thru junction bushing portion and the second feed thru junction bushing portion. The first feed thru junction bushing portion is conductively coupled to the second feed thru junction bushing portion. First, second, and third bushing interfaces are provided for conductively coupling to first, second, and third power cables, respectively. Each of the first, second, and third bushing interfaces include link receiving portions configured to receive the link assembly therein. The link assembly is installable in the first, second, and third bushing interfaces in first and second, reversible orientations.

20 Claims, 6 Drawing Sheets

110
300
304
306
325
327
323
C
346

110
308
346
308
110
D
D
323
300
320
318
302
322
322
306
323
327
300
320
322
324
350
310
344
304
316
314
312
306
C

TRIPLE CAM-OPERATED LINK

CROSS-REFERENCE TO RELATED APPLICATION

This application claims priority under 35. U.S.C. §119, based on U.S. Provisional Patent Application No. 61/439,407 filed Feb. 4, 2011, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to a link for conductively connecting two or more electrical cable connectors.

High or medium voltage switchgear may be provided with link connectors for coupling two or more energized power cables, such as a line cable and a load cable. Such connections may be made via a link assembly that includes contact assemblies connected by a conductive bus bar. The power cables may be connected to the respective contact assemblies, and therefore conductively coupled via the bus bar.

In some implementations, secure seating of the link assembly to the power cables may be provided via a cam-operated link designed to ensure that the link is securely connected to the power cables, usually via a torque-applied clamping action.

DETAILED DESCRIPTION OF THE PREFERRED EMBODIMENTS

The following detailed description refers to the accompanying drawings. The same reference numbers in different drawings may identify the same or similar elements.

Figure 1B:
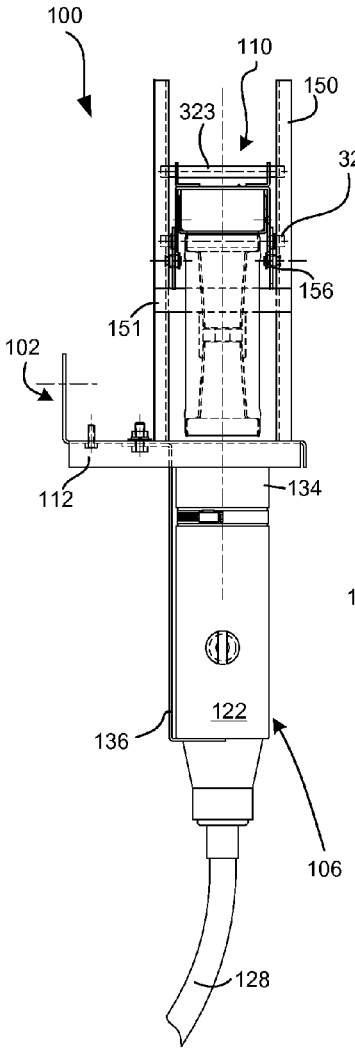
FIG. 1B is a schematic side, partially cross-sectional, view of the electrical cam-op assembly of FIG. 1A, taken along the line A-A in FIG. 1A.
Figure 1A:
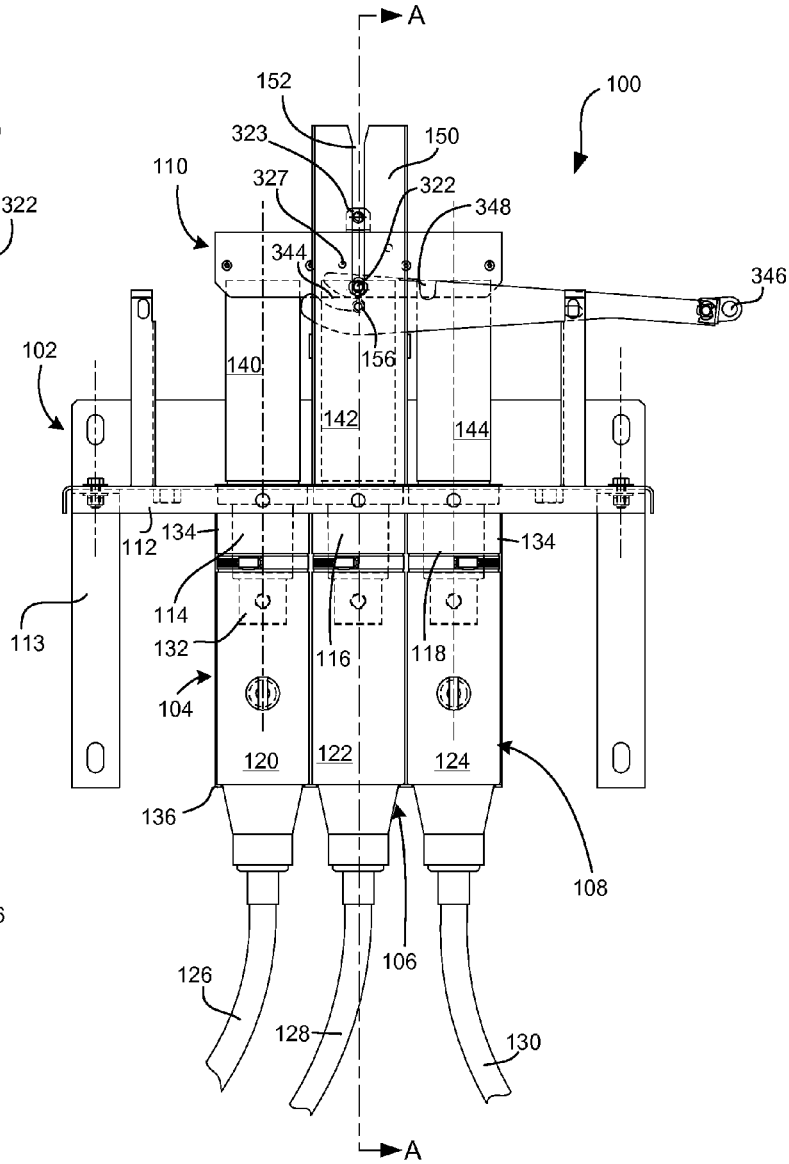
FIG. 1A is a schematic front view of an electrical cam-op assembly consistent with implementations described herein.

FIGS. 1A-4B are various schematic, exploded, assembled, and unassembled views of a switchgear assembly 100 configured in a manner consistent with implementations described herein. As illustrated in FIG. 1A, switchgear assembly 100 may include a mounting panel 102, a first line connector 104, a load connector 106, a second line connector 108, and a triple cam operated link connector assembly 110.

As described herein, switchgear 100 may be configured to enable a selective connection or "link" between either of 1) first line connector 104 and load connector 106 or 2) second line connector 108 and load connector 106, while simultaneously isolating the non-linked connector. For, example, when switchgear assembly 100 is configured to link first line connector 104 and load connector 106, second line connector 108 may be maintained in electrical isolation relative to load connector 106.

It should be noted that the combination of components depicted in switchgear assembly 100 is provided for exemplary purposes only, and any suitable combination or switchgear components may be used in conjunction with embodiments described herein.

As shown in FIGS. 1A and 1B, mounting panel 102 may include a shelf-like structure configured to support connectors 104-108 and triple cam operated link connector assembly 110. More specifically, mounting panel 102 may include shelf 112 and angled support members 113. Shelf 112 may be formed of metal and may include a substantially horizontal portion for directly supporting connectors 104-108 and triple cam operated link connector assembly 110, and a substantially vertical portion extending from the horizontal portion for facilitating connection to a support structure, such as a transformer housing, switchgear enclosure, etc. Although not shown in the Figures, shelf 112 includes one or more apertures for receiving components of connectors 104-108 and/or triple cam operated link connector assembly 110, to facilitate coupling of connectors 104-108 to triple cam operated link connector assembly 110.

Each of connectors 104-108 may include a terminal bushing (e.g., first terminal bushing 114, second terminal bushing 116, and third terminal bushing 118, each of which are shown in dashed lines in FIG. 1A), and a cable connector (e.g., first cable connector 120, second cable connector 122, and third cable connector 124) for facilitating connections between power cables 126, 128, and 130, and corresponding terminal bushings 114-118. As shown in dashed lines FIG. 1A, each terminal bushing 114-118 may include a spade connector 132 extending from a cable side of the terminal bushing. Although not shown in the Figures, upon assembly, cables 126-130 within cable connectors 120-124 may terminate with mating spade connectors for coupling to spade connectors 132.

In one embodiment, each cable connector 120-124 may include a housing 134 configured to engage a cable side of the corresponding terminal bushing (114-118). Connector housing 134 may include an electrically conductive outer shield formed from, for example, a conductive or semi-conductive peroxide-cured synthetic rubber, such as EPDM (ethylene-propylene-dienemonomer). Within the outer shield, power cable connectors 120-124 may include an insulative inner housing, typically molded from an insulative rubber or silicon material. Within the insulative inner housing, power cable connectors 120-124 may include a conductive or semi-conductive insert (not shown) that surrounds the connection portion of power cables 126-130. Cable connectors 120-124 may be secured to terminal bushings 114-118 via any suitable mechanism, such as cable clamps, etc.

In one exemplary implementation, mounting panel 102 may include a cable connector supporting bracket 136 (shown in FIG. 1B). Cable connector supporting bracket 136 may be connected to shelf 112 and may include a horizontal portion to support cable connectors 120-124 following connection of cable connectors 120-124 to bushing terminals 114-118.

Figure 2B:
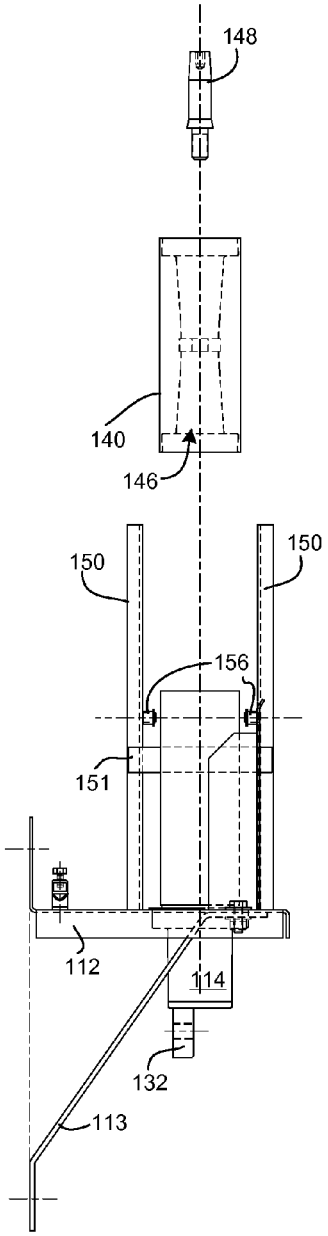
FIG. 2B is a schematic side view of the components of FIG. 2A, taken along the line B-B in FIG. 1A.
Figure 2A:
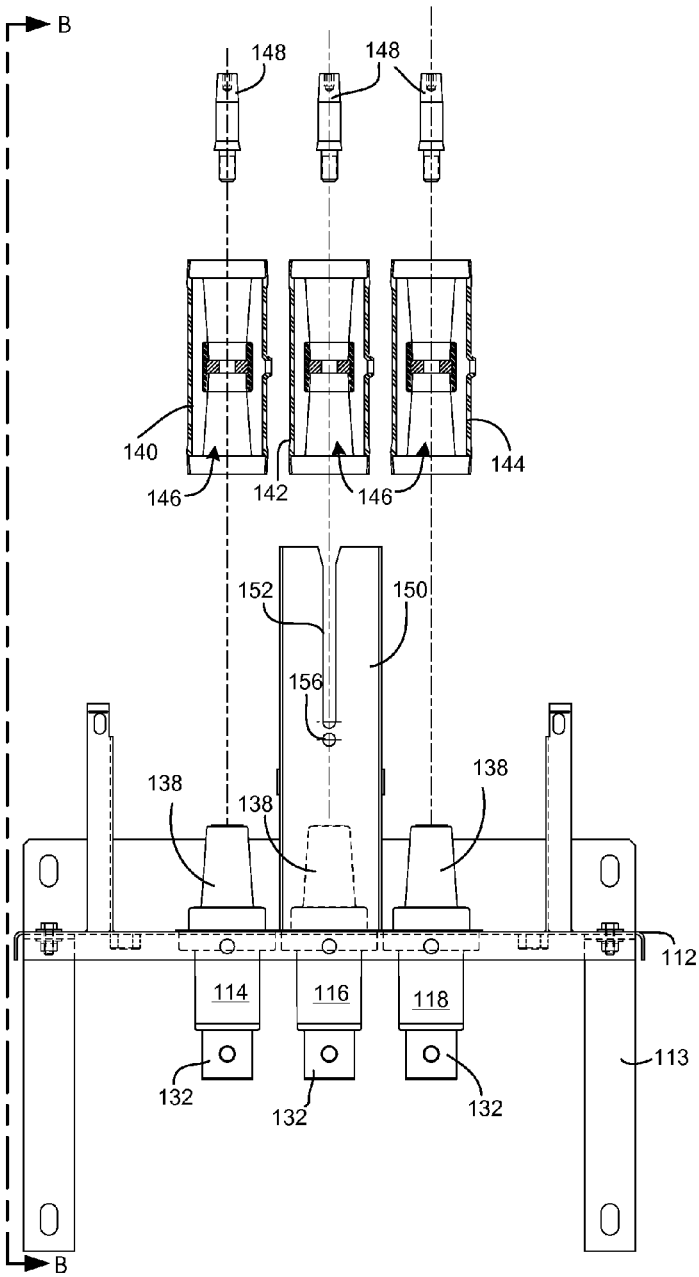
FIG. 2A is an exploded, schematic front view of various components of the electrical cam-op of FIG. 1A.

Referring to FIG. 2A, each of terminal bushings 114-118 may include a link side portion 138 for engagement with a corresponding bushing extender 140, 142, and 144, respectively. As shown, each bushing extender 140-144 may include a substantially tubular body portion having an axial bore 146 therethrough. Bushing extenders 140-144 may be formed of an insulative material, such as rubber or EPDM. Each side of axial bores 146 may be configured to receive a bushing end. For example, the line side of axial bores 146 (e.g., the bottom side in FIG. 2A) may be configured to receive the male link side portion 138 of terminal bushings 114-118. Furthermore, as described in detail below, the link side of bushing extender 140-144 may be configured to receive one of the bushing ends of triple cam-op link connector assembly 110, described in detail below. Although shown in FIG. 2A and described above as comprising individual bushing extenders 140-144, in some implementations, bushing extenders 140-144 may be molded together into a single, integrated bushing extension body.

Retainer sleeves 148 may be received within bores 146 in bushing extenders 140-144 and further received within male link side portion 138 of terminal bushings 114-118 (e.g., via threaded or push-on connections), thereby connecting or securing bushing extenders 140-144 to terminal bushings 114-118. Consistent with embodiments described herein, retainer sleeves 148 may be formed of a conductive material, such as copper, etc., and may form conductive paths from terminal bushings 114-118 (and hence power cables 126, 128, and 130) to triple cam-op link connector assembly 110.

As shown in FIG. 2A, an outer diameter of bushing extenders 140-144 may be larger than the apertures in shelf 112 through which terminal bushings 114-118 extend. In this manner, securing retainer sleeves 148 to terminal bushings 114-118 via bushing extenders 140-144 may cause terminal bushings 114-118 to be secured to shelf 112.

As shown in FIGS. 2A and 2B, mounting panel 102 may include cam-op link support legs 150 (one of which is shown in FIG. 2A, both of which are shown in FIG. 2B). Cam-op link support legs 150 are configured to support triple cam-op link connector assembly 110 and may include substantially rectangular projections spaced apart on opposites sides of terminal bushings 114-118 and projecting away from the remainder of mounting panel 102. Cam-op link support legs 150 may be joined by cross-braces 151 for support, as shown in FIG. 2B.

As shown in FIG. 2A, each cam-op support leg 150 includes a vertical slot or notch 152 formed therein. As shown in FIG. 1A, and described in additional detail below, slot 152 is configured to receive pivot pins 322 and guide pin 323 in triple cam-op link connector assembly 110 during assembly to align bushing portions of triple cam-op link connector assembly 110 with axial bores 146 in bushing extenders 140-144. Furthermore, each cam-op support leg 150 may also include a clamp pin 156 extending inwardly therefrom. As described below, one or more link arms of triple cam-op link connector assembly 110 may pivotally engage clamp pin 156, causing bushing elements of triple cam-op link connector assembly 110 to be securely received/seated within bushing extenders 140-144.

Figures 3A, 3B, 3C:
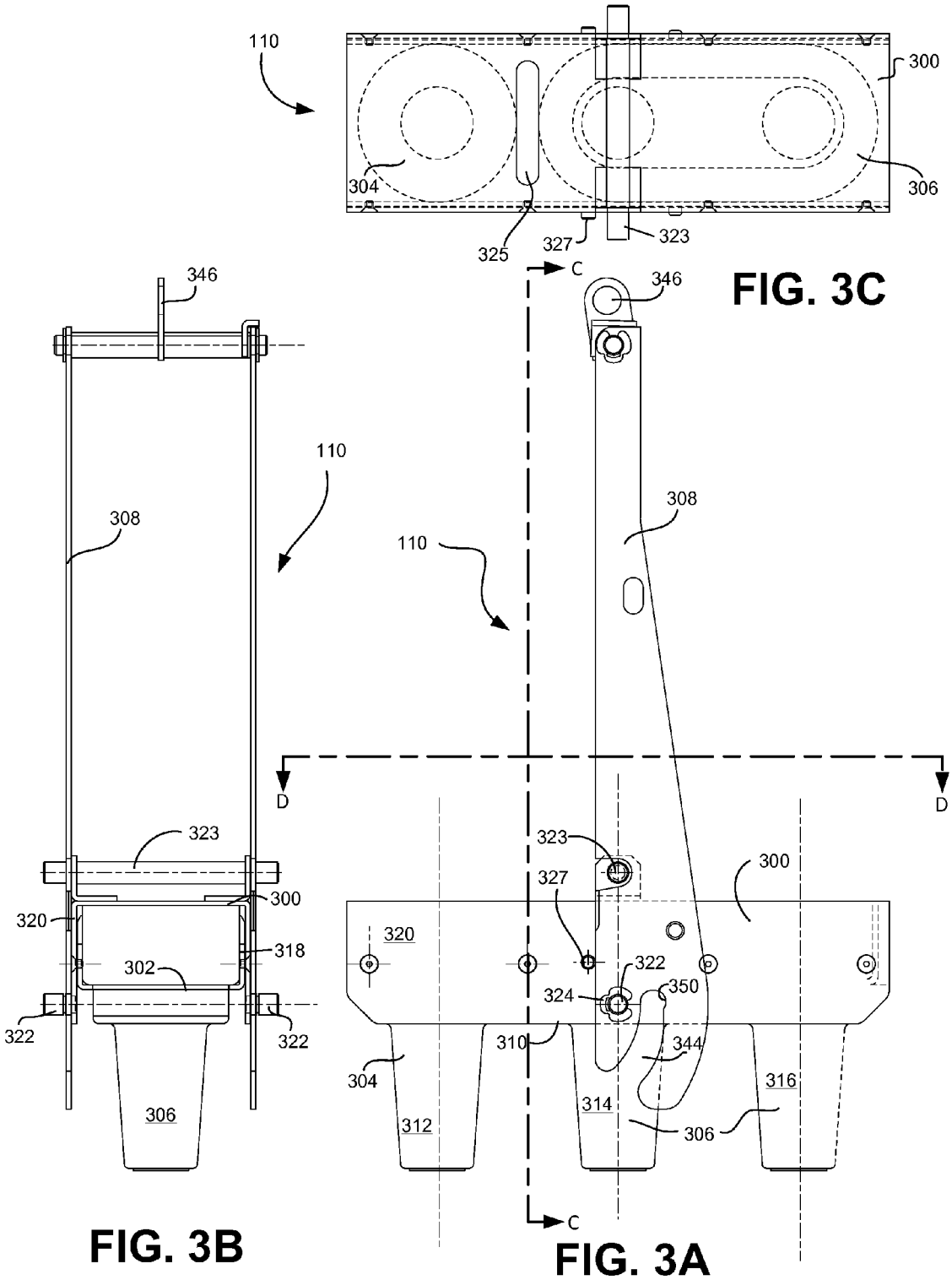
FIG. 3A is a schematic front view of the triple cam-op link connector assembly of FIG. 1A, consistent with implementations described herein.
FIG. 3B is a schematic side view of the triple cam-op link connector assembly of FIG. 3A, taken along the line C-C in FIG. 3A.
FIG. 3C is a schematic top view of the triple cam-op link connector assembly of FIG. 3A, taken along the line D-D in FIG. 3A.
Figure 4B:
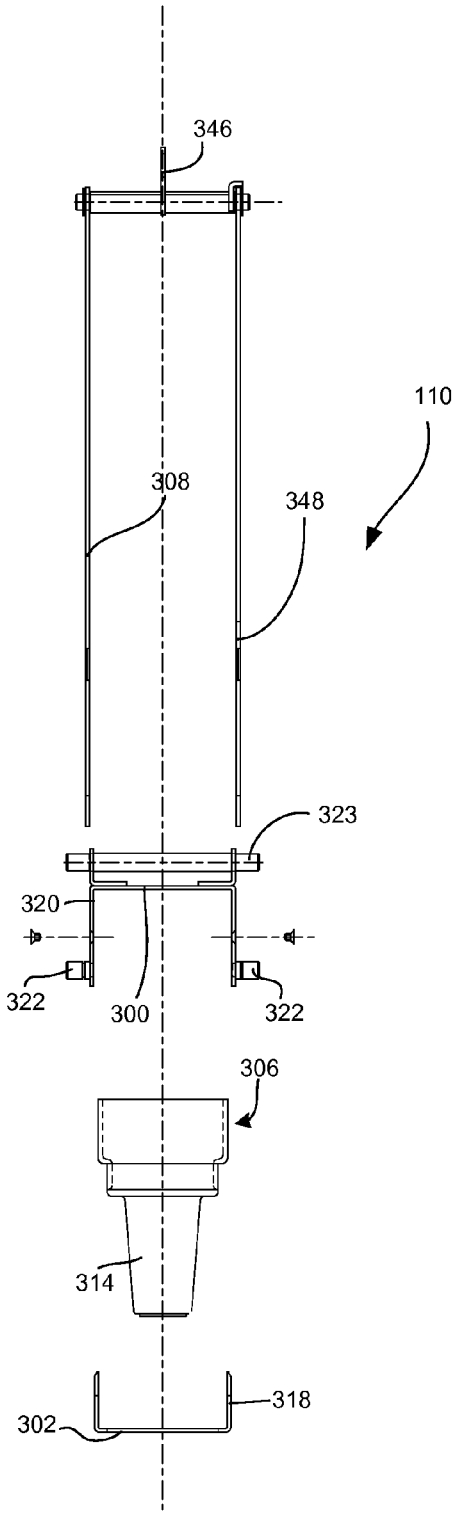
FIG. 4B is an exploded, schematic cross-sectional view of the triple cam-op link connector assembly of FIG. 4A, taken along the line E-E in FIG. 3A.
Figure 4A:
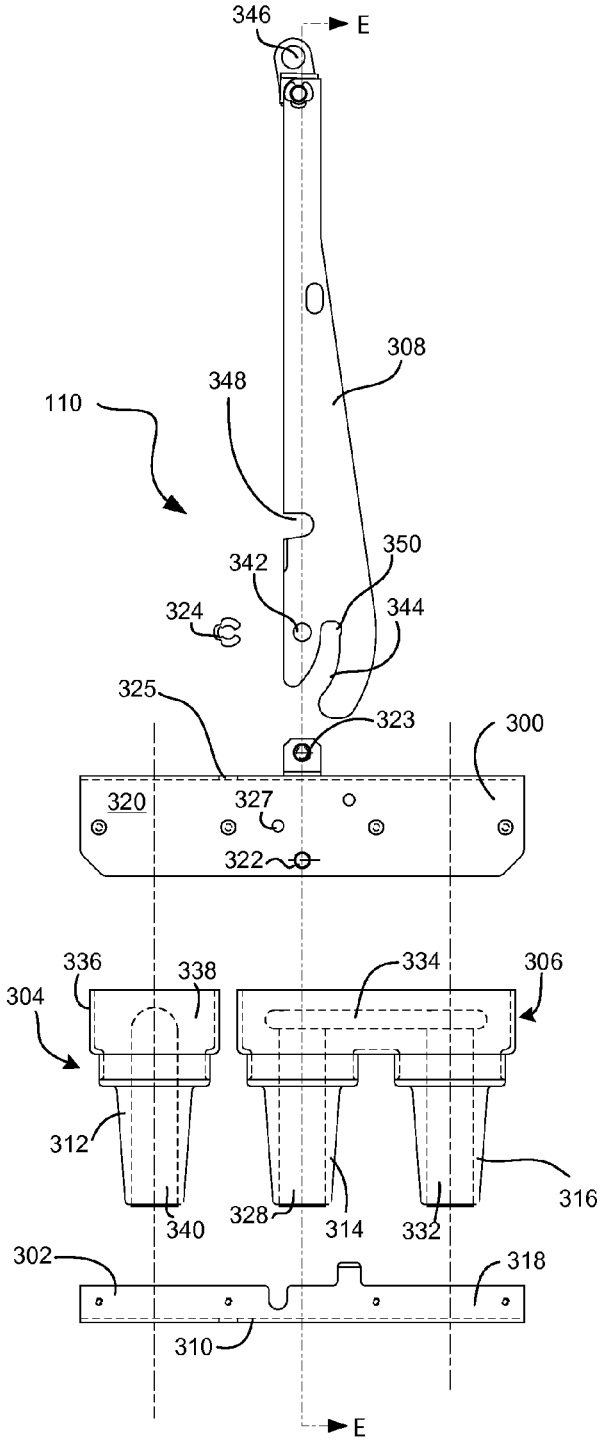
FIG. 4A is an exploded, schematic front view of the triple cam-op link connector assembly of FIG. 3A.

FIGS. 3A, 3B, and 3C are schematic front, side, and top views, respectively, of an exemplary triple cam-op link connector assembly 110 consistent with implementations described herein. FIGS. 4A and 4B are exploded schematic front, and side views of triple cam-op link connector assembly 110. As shown, triple cam-op link connector assembly 110 may include a link bracket body portion 300, a clamp plate 302, insulated plug 304, feed thru junction 306, and link arms 308.

Consistent with embodiments described herein, triple cam-op link connector assembly 110 may be configured to operate in two different modes or orientations. In a first orientation (depicted schematically in FIG. 5A), triple cam-op link connector assembly 110 is installed such that feed thru junction 306 is received within bushing extenders 142 and 144 and insulated plug 304 is received within bushing extender 140. This creates a conductive link between load 106 and line 108 and insulates line 104.

In a second orientation (depicted schematically in FIG. 5B), triple cam-op link connector assembly 110 is removed from cam-op support leg 150 and reversed from the first orientation, such that feed thru junction 306 is received within bushing extenders 140 and 142 and insulated plug 304 is received within bushing extender 144. This creates a conductive link between line 104 and load 106 and insulates line 108.

Although a cam-op link embodiment is described herein, it should be understood that other devices may be used in other embodiments consistent with implementations described herein. For example, a tie-down link or other interface embodiment may be used without departing from the scope of the described embodiments.

Link bracket body portion 300 and a clamp plate 302 may support feed thru junction 306 and insulated plug 304 in a pre-installed and aligned orientation. More specifically, link bracket body portion 300 and a clamp plate 302 may form opposing substantially U-shaped support structures. As shown in FIG. 3A, a bottom surface 310 of clamp plate 302 may include apertures for receiving bushing portions 312, 314, and 316, of insulated plug 304, and feed thru junction 306, respectively. In one implementation, upwardly projecting sides 318 of clamp plate 302 may be received within downwardly projecting sides 320 of link bracket body portion 300. Sides 320 and 318 may then be secured to each other via any suitable mechanisms, such as screws (as shown in FIGS. 3A, and 4B), rivets, etc.

In addition, link bracket body portion 300 may include pivot pins 322 that project outwardly from intermediate portions of sides 320. In other implementations, sides 320 of link bracket body portion 300 may be received within sides 318 of clamp plate 302. In this implementation, pivot pins 322 may be secured to and may project from sides 320, rather than sides 318.

In any case, pivot pins 322 may be rotatably secured to link arms 308, such that link arms may be rotatable about pivot pins 322 from a substantially vertical position (as shown in FIG. 3A) to a substantially horizontal installed position (as shown in FIG. 1A). In some embodiments, link arms 308 may be secured to pivot pins 322 via retaining clips 324 (one of which is shown in FIGS. 3A and 4A). As shown in FIGS. 3A, 3C, and 4A, link bracket body portion 300 may also include stop pin 327 for preventing link arms 308 from rotating past the vertical position as described in detail below.

As shown in FIG. 4A, feed thru junction 306 may include first bushing portion 314 having a first contact assembly 328 provided therein, second bushing portion 316 having a second contact assembly 332 provided therein, and a bus bar 334 conductively coupling first contact assembly 328 to second contact assembly 332.

Figure 5A:
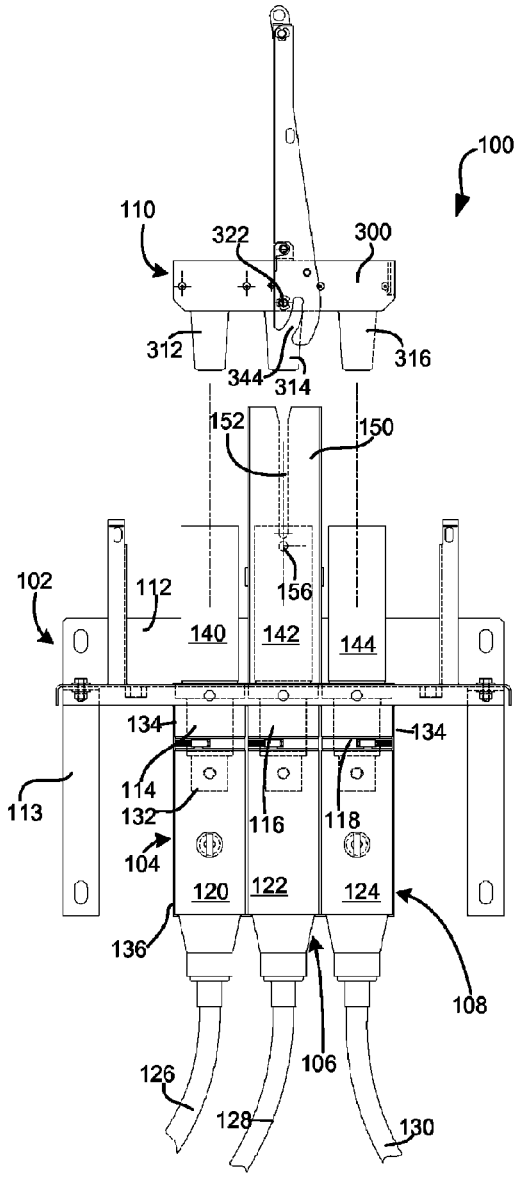
FIGS. 5A and 5B are exploded schematic front views of the electrical switchgear assembly of FIG. 1A in a first mode of operation and a second mode of operation, respectively.
Figure 5B:
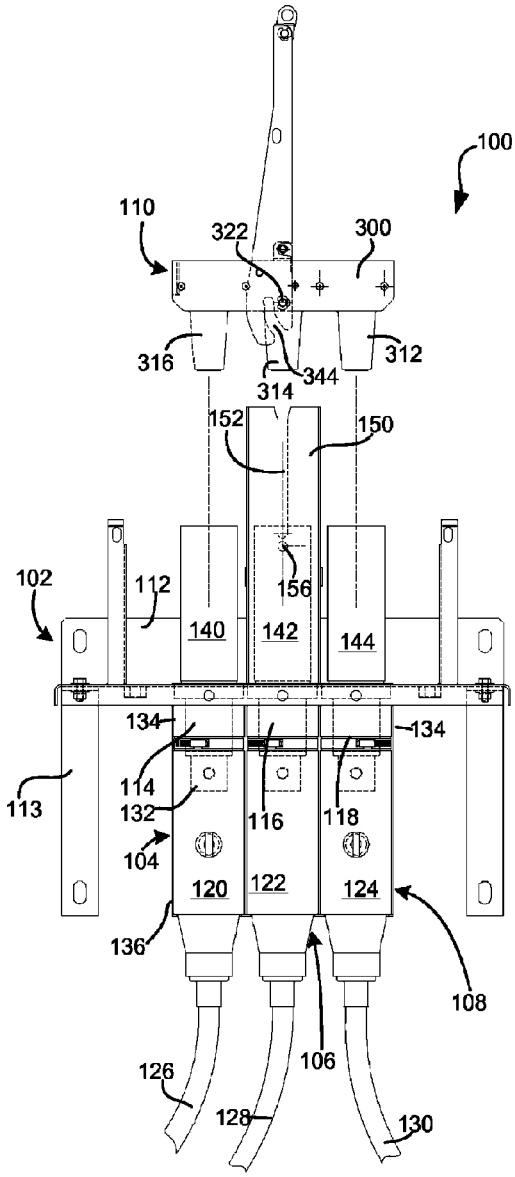

As shown in FIGS. 5A and 5B, first and second bushing portions 314 and 316 may be configured to engage two of bushing extenders 140-144, depending on the mode of operation, as briefly described above. Contact assemblies 328 and 332, and bus bar 334 may be formed of a conductive material, such as copper or aluminum. Moreover, feed thru junction 306 may include an electrically conductive outer shield formed from, for example, a conductive or semi-conductive peroxide-cured synthetic rubber (e.g., EPDM). In other implementations, at least a portion of feed thru junction 306 may be painted with conductive or semi-conductive paint. Within the outer shield, feed thru junction 306 may include an insulative inner housing surrounding contact assemblies 328 and 332, and bus bar 334, typically molded from an insulative rubber or epoxy material.

Insulated plug 304 may include an outer conductive shield 336, an insulating body portion 338, and a conductive core portion 340. As shown in FIGS. 5A and 5B, insulated plug 304 may be configured to engage one of bushing extenders 140 or 144, depending on the mode of operation, as briefly described above.

As described briefly above, insulated plug 304 and feed thru junction 306 may be secured within link bracket body portion 300 and a clamp plate 302 during assembly of triple cam-op link connector assembly 110. Such configuration maintains insulated plug 304 and feed thru junction 306 in a spaced relationship substantially similar to a spacing of bushing extenders 140-144, thereby facilitating easy installation of triple cam-op link connector assembly 110.

As shown in FIG. 3C, in one implementation, link bracket body portion 300 may include a visible open window portion 325 that allows a technician to visibly ascertain which portions of triple cam-op link connector assembly 110 are electrically connected. That is, visual inspections via window portion 325 makes it easy to determine which side of triple cam-op link connector assembly 110 is the insulated side and, accordingly, which line (line 108 or line 104) is connected to load 106.

Returning to FIGS. 4A and 4B, link arms 308 include a pair of substantially elongated members adapted to provide a clamping force between triple cam-op link connector assembly 110 and mounting panel 102 (e.g., via clamp pins 156 in cam-op link support legs 150, shown in FIG. 2B), thereby securing triple cam-op link connector assembly 110 to bushing extenders 140-144. As shown in FIG. 4A, link arms 308 may include apertures 342 for engaging pivot pins 322. In addition, link arms 308 may also include curved clamp pin engagement slots 344 for engaging clamp pins 156 in cam-op link support legs 150. Link arms 308 may also include a hole 346 in the end of link arms 308 distal from pivot pin 322, for enabling engagement of link arms 308 by a suitable tool, such as a hot stick or other lineman's tool.

Rotation of link arms 308 about pivot pin 322 when triple cam-op link connector assembly 110 is installed in mounting panel 102 (e.g., in support legs 150) may cause clamp pin engagement slot 344 to slidingly engage clamp pins 156. In one implementation, each clamp pin engagement slot 344 may include a pin-retaining portion 350. As shown, pin-retaining portions 350 may be formed at a terminating end of clamp pin engagement slots 344 and may include a notched portion configured to retain clamp pins 156 in clamp pin engagement slots 344 to prevent undesired rotation of link arms 308.

FIGS. 5A and 5B are exploded schematic front views of cam-op assembly 100 in the first mode of operation and the second mode of operation, respectively. As a point of reference, FIGS. 1A and 1B illustrate schematic front and side views of assembled/installed switchgear assembly 100 in the first mode of operation, in which triple cam-op link connector assembly 110 has been seated and clamped to bushing extenders 140-144, via clamp pins 156 on support legs 150.

As shown in FIG. 5A, in configuring assembly 100 for the first mode of operation, triple cam-op link connector assembly 110 may be positioned relative to mounting panel 102 and bushing extenders 140-144 such that insulated plug 304 is aligned with bushing extender 140, first bushing portion 314 is aligned with bushing extender 142, and second bushing portion 316 is aligned with bushing extender 144. In this position, pivot pins 322 may be aligned with vertical slots 152 in cam-op link support legs 150.

Upon installation, triple cam-op link connector assembly 110 may be moved toward bushing extenders 140-144, with pivot pins 322 and guide pin 323 being received (and guided by) slots 152, insulated plug 304 being received within bushing extender 140, first bushing portion 314 of feed thru junction 306 being received within bushing extender 142, and second bushing portion 316 of feed thru junction 306 being received within bushing extender 144.

When triple cam-op link connector assembly 110 is seated within bushing extenders 140-144, clamp pins 156 may engage openings of clamp pin engagement slots 344. As shown in FIG. 1A, once triple cam-op link connector assembly 110 has been seated within bushing extenders 140-144, link arms 308 may be rotated about pivot pin 322 to lock or secure triple cam-op link connector assembly 110 to bushing extenders 140-144. That is, upon rotation of link arms 308, clamp pin engagement slots 344 may slidingly engage clamp pins 156. The location and curved nature of clamp pin engagement slots 344 may cause triple cam-op link connector assembly 110 to become securely seated within bushing extenders 140-144 by virtue of the engagement between clamp pins 156 and clamp pin engagement slots 344. At the completion of the rotation of link arms 308, clamp pins 156 may be seated within pin retaining portions 350 to prevent unintentional movement of link arm 308 relative to bushing extenders 140-144 or mounting panel 102.

Once installed in the manner shown in FIGS. 1A and 5A, terminal bushing 114 (and power cable 126 connected thereto) may be insulated by insulated plug 304, and terminal bushings 116 and 118 (and power cables 128 and 130 connected thereto) may be conductively coupled via feed thru junction 306. The insulated nature of terminal bushing 114 may be visually ascertained via visible open window portion 325 in link bracket body portion 300.

As shown in FIG. 5B, in configuring assembly 100 for the second mode of operation, triple cam-op link connector assembly 110 may be reversed from the positioning described above in relation to the first mode of operation. That is, triple cam-op link connector assembly 110 may be positioned relative to mounting panel 102 and bushing extenders 140-144 such that insulated plug 304 is aligned with bushing extender 144, first bushing portion 314 is aligned with bushing extender 142, and second bushing portion 316 is aligned with bushing extender 140. Given the symmetrical nature of triple cam-op link connector assembly 110, in the second mode position, pivot pins 322 are maintained in alignment with vertical slots 152 in cam-op link support legs 150.

Upon installation, triple cam-op link connector assembly 110 may be moved toward bushing extenders 140-144, with pivot pins 322 and guide pin 323 being received (and guided by) slots 152. Insulated plug 304 being received within bushing extender 144, first bushing portion 314 of feed thru junction 306 being received within bushing extender 142, and second bushing portion 316 of feed thru junction 306 being received within bushing extender 140.

When triple cam-op link connector assembly 110 is seated within bushing extenders 140-144, clamp pins 156 engage openings of clamp pin engagement slots 344, and link arms 308 may be rotated about pivot pin 322 to lock or secure triple cam-op link connector assembly 110 to bushing extenders 140-144, in the manner described above in relation to the first mode of operation.

Once installed in the manner indicated by FIG. 5B, terminal bushing 118 (and power cable 130 connected thereto) may be insulated by insulated plug 304, and terminal bushings 114 and 116 (and power cables 126 and 128 connected thereto) may be conductively coupled via feed thru junction 306. The insulated nature of terminal bushing 118 may again be visually ascertained via visible open window portion 325 in link bracket body portion 300.

Figure 6B:
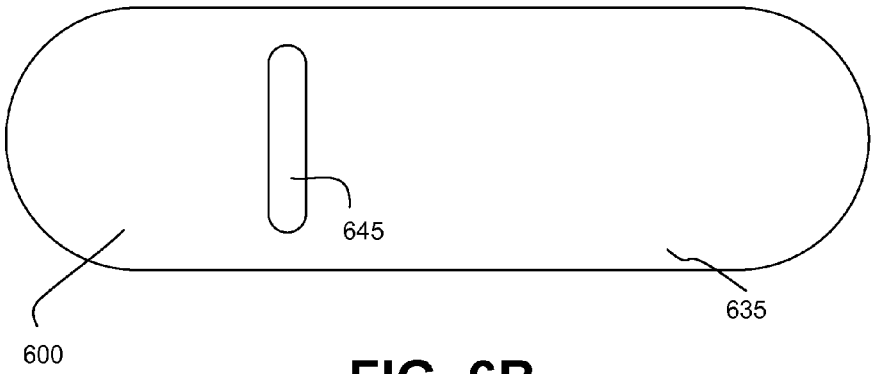
FIG. 6B is a schematic top view of the triple cam-op bushing assembly of FIG. 6A, taken along the line F-F in FIG. 6A.
Figure 6A:
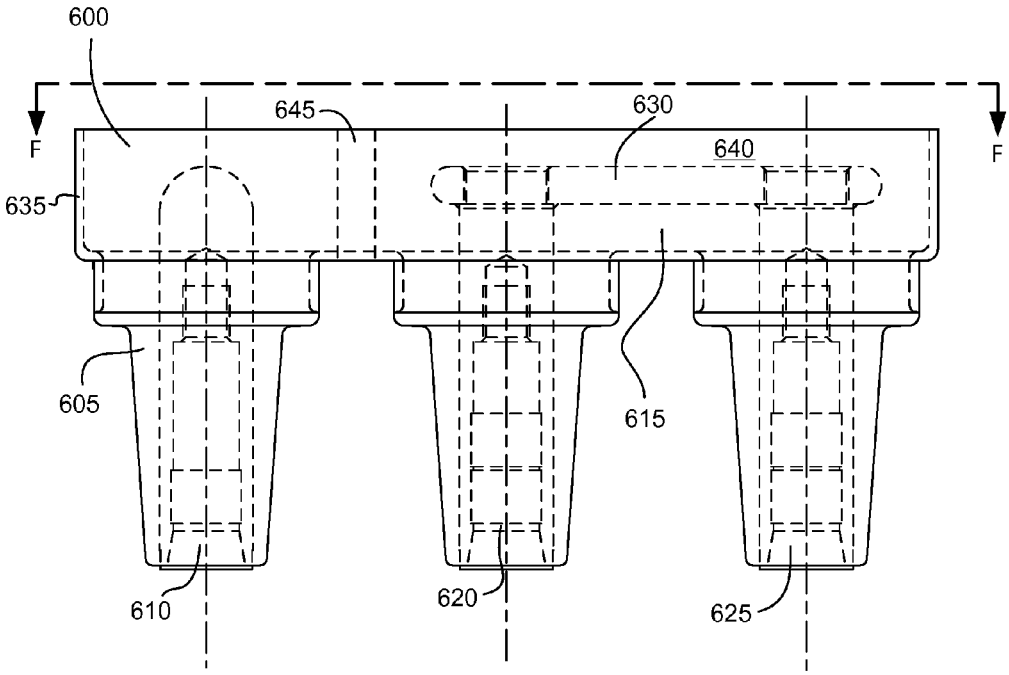
FIG. 6A is a schematic front view of a triple cam-op bushing assembly consistent with implementations described herein.

FIGS. 6A and 6B are a front view and top view, respectively, of a triple cam-op bushing assembly 600 consistent with implementations described herein. Contrary to the embodiment of FIGS. 4A and 4B, triple cam-op bushing assembly 600 is a molded one-piece design that incorporates both an insulated plug and a feed thru function into one component. As shown in FIG. 6A, triple cam-op bushing assembly 600 may include an insulated bushing portion 605 configured similarly to insulated plug 304 described above to include an inner conductive portion 610 for engaging one or bushing extenders 140 or 144 depending on the mode of operation.

In addition, triple cam-op bushing assembly 600 may include a feed thru bushing portion 615 having a first contact assembly 620, a second contact assembly 625, and a bus bar 630 that electrically couples first contact assembly 620 to second contact assembly 625. Triple cam-op bushing assembly 600 may include an outer conductive shield 635 and an insulating body portion 640 formed around conductive portion 610 of insulated bushing portion 605, first contact assembly 620, bus bar 630, and second contact assembly 625.

As shown in FIGS. 6A and 6B, triple cam-op bushing assembly 600 may include a visible open window 645 that provides a visible determination of non-conductivity between insulated bushing portion 605 and feed thru bushing portion 615. For example, a transparent, insulative material may be formed within triple cam-op bushing assembly 600, such that visible open window 645 is aligned with visible open window portion 325 in link bracket body portion 300. As such, visible open window portion 645 enables a worker to visibly confirm that no contact is provided between insulated bushing portion 605 and feed thru bushing portion 615. Consistent with aspects described herein, the one-piece nature of triple cam-op bushing assembly 600 may increase the ease with which triple cam-op link connector assembly 110 may be assembled.

The above described triple cam-op link connector assembly provides an easy to use, effective, and safe mechanism for selectively providing electrical connectivity between two of three available power cables, while simultaneously enabling visual confirmation of the insulated nature of the third available cable. More specifically, consistent with aspects described herein, a symmetrical triple link arrangement may be used in which electrical connectivity is selectively provided between first and second connected power cables in a first mode of operation, or second and third connected power cables in a second mode of operation. The symmetrical arrangement of the link enables selection of the mode of operation by removing, reversing, and re-installing the link.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other medium or high voltage switchgear equipment, such as any 15 kV, 25 kV, 35 kV, or higher voltage equipment, including both deadbreak-class and loadbreak-class equipment. In addition, although the above-described triple cam-op link connector assembly comprises an insulated plug and a two bus bar connected contact assemblies, other configurations may be incorporated without departing from the scope and spirit of the invention. For example, a triple cam-op link connector assembly that includes one or more ground or pass-through terminals may be used.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A high voltage link apparatus, comprising:
a link assembly, comprising:
an insulated bushing portion;
a first feed thru junction bushing portion; and
a second feed thru junction bushing portion,
wherein the insulated bushing portion is electrically isolated from the first feed thru junction bushing portion and the second feed thru junction bushing portion, and
wherein the first feed thru junction bushing portion is conductively coupled to the second feed thru junction bushing portion;
a first bushing interface for conductively coupling to a first power cable;
a second bushing interface for conductively coupling to a second power cable; and
a third bushing interface for conductively coupling to a third power cable,
wherein each of the first, second, and third bushing interfaces include link receiving portions configured to receive the link assembly therein, and
wherein the link assembly is installable in the first, second, and third bushing interfaces in first and second orientations,
wherein, in the first orientation, the insulated bushing portion is received in the link receiving portion of the first bushing interface, the first feed thru junction bushing portion is received in the link receiving portion of the second bushing interface, and the second feed thru junction bushing portion is received in the link receiving portion of the third bushing interface, and
wherein, in the second orientation, the insulated bushing portion is received in the link receiving portion of the third bushing interface, the first feed thru junction bushing portion is received in the link receiving portion of the second bushing interface, and the second feed thru junction bushing portion is received in the link receiving portion of the first bushing interface.

2. The high voltage link apparatus of claim 1, wherein the link assembly comprises a cam-operated link assembly.

3. The high voltage link apparatus of claim 2, further comprising:

a mounting panel for supporting the first, second, and third bushing interfaces; and support arms fixed relative to the mounting panel, wherein the cam-operated link assembly further comprises:

a bracket for supporting the insulated bushing portion, the first feed thru junction bushing portion, and the second feed thru junction bushing portion; and a link arm rotatably coupled to the bracket via a pivot pin, wherein the cam-operated link assembly is received in the support arms in both the first and second orientations.

4. The high voltage link apparatus of claim 3, wherein the support arms include a clamp pin projecting therefrom; and wherein the link arms include a clamp pin engagement slot for engaging the clamp pin during movement of the link arms.

5. The high voltage link apparatus of claim 3, wherein the bracket comprises a visible open window positioned between the insulated bushing portion and the first feed thru junction bushing portion for enabling visual confirmation of a disconnection between the insulated bushing portion and the first feed thru junction bushing portion.

6. The high voltage link apparatus of claim 3, further comprising:

a link body for enclosing the insulated bushing portion, the first feed thru junction bushing portion, and the second feed thru junction bushing portion, wherein the link body includes a visible open port between the insulated bushing portion and the first feed thru junction bushing portion.

7. The high voltage link apparatus of claim 6, wherein the link body comprises an outer housing and an inner insulated body portion; and wherein the visible open port comprises a transparent portion of the outer housing and the inner insulated body portion.

8. The high voltage link apparatus of claim 1, further comprising:

a bus bar for conductively coupling the first feed thru junction bushing portion to the second feed thru junction bushing portion.

9. The high voltage link apparatus of claim 8, wherein the first feed thru junction bushing portion includes a first contact assembly configured to engage the second bushing interface, wherein the second feed thru junction bushing portion includes a second contact assembly configured to engage either the first or third bushing interfaces, depending on the orientation, and wherein the bus bar conductively couples the first contact assembly to the second contact assembly.

10. The high voltage link apparatus of claim 1, wherein the first, second, and third bushing interfaces further comprise:

first, second, and third terminal bushings electrically coupled to the first, second, and third power cables, respectively;

first, second, and third bushing extenders coupled to the first, second, and third terminal bushings; and first, second, and third, retainer sleeves received within the first, second, and third bushing extenders and configured to secure the bushing extenders to the first, second, and third terminal bushings.

11. The high voltage link apparatus of claim 1, wherein the first, second, and third bushing interfaces are fixedly mounted to a mounting panel.

12. A system, comprising:

a mounting panel for receiving first, second, and third terminal bushings therein, wherein the first, second, and third terminal bushings are configured to be coupled to first, second, and third power cables, respectively;

first, second, and third bushing extenders configured to engage the first, second, and third terminal bushings and secure the first, second, and third terminal bushings to the mounting panel, wherein the first second and third bushing extenders include link receiving portions therein;

a link assembly including first, second, and third bushing portions for engaging the first, second, and third bushing extenders, wherein the link assembly is installable in the link receiving portions of the first, second, and third bushing extenders in first and second orientations, wherein, in the first orientation, the link assembly is configured to conductively couple the second and third terminal bushings, and wherein, in the second orientation, the link assembly is configured to conductively couple the first and second terminal bushings.

13. The system of claim 12, wherein the link assembly comprises:

an insulated bushing portion;

a first feed thru junction bushing portion; and a second feed thru junction bushing portion, wherein the insulated bushing portion is electrically isolated from the first feed thru junction bushing portion and the second feed thru junction bushing portion, and wherein the first feed thru junction bushing portion is conductively coupled to the second feed thru junction bushing portion.

14. The system of claim 13, wherein the link assembly comprises a bus bar for conductively linking the first feed thru junction bushing portion to the second feed thru junction bushing portion.

15. The system of claim 14, wherein the link assembly further comprises:

a link body for enclosing the insulated bushing portion, the first feed thru junction bushing portion, and the second feed thru junction bushing portion, wherein the link body includes a visible open port between the insulated bushing portion and the first feed thru junction bushing portion.

16. The system of claim 12, wherein the link assembly comprises a cam-operated link assembly.

17. The system of claim 16, further comprising:

support arms fixed relative to the mounting panel, wherein the cam-operated link assembly further comprises:

a bracket for supporting the first bushing portion, the second bushing portion, and the third bushing portion; and a link arm rotatably coupled to the bracket via a pivot pin, wherein the cam-operated link assembly is received in the support arms in both the first and second orientations.

18. The system of claim 17, wherein the support arms include a clamp pin projecting therefrom; and wherein the link arms include a clamp pin engagement slot for engaging the clamp pin during rotation of the link arms.

19. The system of claim 16, wherein the link arm is moveable to secure the cam-op link assembly to the support arms.

20. The system of claim 12, further comprising:

first, second, and third cable connectors for coupling first, second, and third power cables, to the first second, and third terminal bushings; and a cable connector support bracket connected to the mounting panel and configured to support the first, second, and third cable connectors.

* * * * *